United States Patent [19]

Cha

[11] 4,367,901

[45] Jan. 11, 1983

[54] METHOD FOR FORMING AN IN SITU OIL SHALE RETORT

[75] Inventor: Chang Y. Cha, Golden, Colo.

[73] Assignee: Occidental Oil Shale, Inc., Grand Junction, Colo.

[21] Appl. No.: 201,631

[22] Filed: Oct. 28, 1980

[51] Int. Cl.[3] ..... E21C 41/10

[52] U.S. Cl. ..... 299/2; 102/312; 299/13

[58] Field of Search ..... 299/2, 13; 102/311, 102/312

[56] References Cited

U.S. PATENT DOCUMENTS

| | | | |
|---|---|---|---|
| 1,195,781 | 8/1916 | Clark | 299/13 |
| 3,466,094 | 9/1969 | Haworth et al. | 299/13 |
| 4,025,115 | 5/1977 | French et al. | 299/2 |

OTHER PUBLICATIONS

Blasters Handbook, DuPont, 15th Edition, pp. 412–419.

Swedish Blasting Technique by Rune Gustafsson, Pub. by SPI, Sweden, (no date).

Garrett Research Internal Memo, by R. Ridley, Sep. 27, 1974.

*Primary Examiner*—Ernest R. Purser

*Attorney, Agent, or Firm*—Arnold Grant

[57] ABSTRACT

An in situ oil shale retort is formed in a subterranean formation containing oil shale, a horizontally extending void is excavated within the boundaries of the retort site leaving a zone of unfragmented formation above and/or below such a void. A crack is propagated in at least one of the zones of unfragmented formation along the side boundaries of the retort site and thereafter the zone of unfragmented formation is explosively expanded towards such a void for forming a fragmented permeable mass of formation particles in the retort. Such a fragmented permeable mass is retorted in situ to produce shale oil.

18 Claims, 4 Drawing Figures

METHOD FOR FORMING AN IN SITU OIL SHALE RETORT

FIELD OF THE INVENTION

This invention relates to the formation of a fragmented permeablized mass of formation particles in an in situ oil shale retort.

BACKGROUND OF THE INVENTION

The invention relates to a technique for forming a fragmented permeable mass of particles in an in situ oil shale retort. More particularly, this invention relates to technique for explosive expansion of unfragmented formation into voids excavated within the retort site which technique minimizes the occurrence of a relatively higher void fraction region along the side boundaries of the retort and a low void fraction region near the center of the retort.

The presence of large deposits of oil shale in the semi-arid high plateau region of the Western United States has given rise to extensive efforts to develop methods for recovering shale oil from kerogen in the oil shale deposits. It should be noted that the term "oil shale" as used in the industry is, in fact, a misnomer, it is neither shale nor does it contain oil, it is a sedimentary formation comprising marlstone deposit with layers containing an organic polymer called "kerogen" which, upon heating decomposes to produce liquid and gaseous products. It is the formation containing kerogen that is called "oil shale" herein and the liquid hydrocarbon product is called "shale oil."

A number of methods have been proposed for producing shale oil from oil shale; these generally involve either mining the kerogen-bearing shale and removing it to the surface for processing into shale oil or rubblization and processing of the shale in situ. The latter approach is preferable from the standpoint of environmental impact since the treated shale remains in place, reducing the chance of surface contamination and the requirement for disposal of large quantities of solid wastes.

The recovery of liquid and gaseous products from oil shale deposits has been described in several patents such as U.S. Pat. Nos. 3,661,423; 4,043,597; 4,043,598; and 4,153,298, as well as pending applications including U.S. patent application Ser. No. 929,250, filed July 31, 1978, by Thomas E. Ricketts, now U.S. Pat. No. 4,192,554, and U.S. patent application Ser. No. 070,319, filed Aug. 27, 1979, by Chang Yul Cha, entitled TWO-LEVEL HORIZONTAL FREE FACE MINING SYSTEM FOR IN SITU OIL SHALE RETORTS now abandoned. Each of these patents and applications is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein the formation is explosively expanded to form an in situ fragmented permeable mass of formation particles containing oil shale, referred to herein as a "retort" or as an "in situ oil shale retort". Retorting gases are passed through the fragmented mass to convert kerogen contained in the oil shale to liquid and gaseous products, thereby producing retorted oil shale. One method of supplying hot retorting gases used for converting kerogen contained in the oil shale as described in U.S. Pat. No. 3,661,423, includes establishing a combustion zone in the retort and introducing an oxygen-supplying retort inlet mixture into the retort to advance the combustion zone through the fragmented mass. In the combustion zone oxygen from the retort inlet mixture is depleted by reaction with hot carbonaceous materials to produce heat, combustion gas and combusted oil shale. By the continued introduction of the retort inlet mixture into the fragmented mass, the combustion zone is advanced through the fragmented mass in the retort.

The combustion gas and that portion of the retort inlet mixture which does not take part in the combustion process pass through the fragmented mass on the advancing side of the combustion zone to heat the oil shale to a temperature sufficient to produce kerogen decomposition; this process, called "retorting," takes place in a retorting zone. Such decomposition of the oil shale in the retorting zone produces gaseous and liquid products, including gaseous and liquid hydrocarbons, and a residual carbonaceous material.

The liquid products and the gaseous products are cooled by the cooler oil shale fragments in the retort on the advancing side of the retorting zone. These products, together with water produced in or added to the retort, collect at the bottom of the retort and are withdrawn.

U.S. Pat. Nos. 4,043,597 and 4,043,598, and 4,192,554, disclose methods for explosively expanding formation containing oil shale toward horizontal free faces to form a fragmented mass in an in situ oil shale retort. According to such a method a plurality of vertically spaced apart voids of similar horizontal cross section are initially excavated one above another within the retort site. At least one zone of unfragmented formation is temporarily left between the voids. Explosive is placed in each of the unfragmented zones and detonated to explosively expand each unfragmented zone upwardly and/or downwardly towards the void or voids above and/or below it to form a fragmented mass having an average void volume about equal to the void volume of the initial voids. Retorting of the fragmented mass is then carried out as described above to recover shale oil from the oil shale.

U.S. Pat. No. 4,153,298 describes a method for forming a retort by excavating at least one horizontally extending void adjacent a zone of unfragmented formation to be expanded. At least one support pillar of unfragmented formation is left in the void for supporting overburden. Explosive is placed in the zone of unfragmented formation and in such a support pillar. Explosive in such a pillar and in the zone of unfragmented formation is detonated in a single round of explosions with a time delay between detonation of explosive in such a pillar and detonation of explosive in the zone of unfragmented formation for first expanding such a pillar toward the void and then expanding unfragmented formation toward the void. The time delay is sufficient for creation of a free face at the juncture of such a pillar and the zone of unfragmented formation. The time delay is short enough that explosive in the zone of unfragmented formation is detonated before particles formed by explosive expansion of the pillars have come to rest on the floor of the void.

Recovery of the shale oil resource is directly related to the distribution of the void fraction in the fragmented mass of oil shale particles. It is desirable to have a uniformly distributed void fraction in the fragmented mass so that there is generally uniform permeability, both horizontally across the retort and vertically along the length of the retort. With a uniformly distributed void fraction oxygen supplying gas and combustion gas can flow reasonably uniformly through the fragmented mass during retorting operations. A fragmented mass having generally uniform permeability prevents the retorting gas from bypassing portions of the fragmented mass as can occur if there is gas channelling through a portion of the mass due to non-uniform permeability.

It was found upon forming a retort generally in accordance with the description in U.S. Pat. No. 4,192,554 that the fragmented mass of particles had a relatively high void volume fraction region along the side boundaries of the retort and a low void fraction region nearer the center of the retort. It is theorized that during explosive expansion there is a tendency for oil shale to be expanded preferentially away from the walls of the retort due to the force balance of expanding gas generated by the explosion. Expanding gas from explosive in the central portion of the retort, according to this theory, encounters reasonably uniform resistance so that the net direction of expansion is essentially vertical. Near the side boundaries, however, gas pressure extending laterally toward the boundary is resisted by the unfragmented formation that will form the walls of the retort and the resultant force balance thus has a component directed away from the walls. This tends to cause preferential expansion away from the walls and results in a high void fraction region adjacent the walls. Another theory for understanding the high void fraction region near the walls assumes that particles in the central region of the retort can expand vertically without substantial rotation due to adjacent particles which are also expanding vertically. Particles adjacent the walls encounter the unfragmented walls and the resultant friction causes partial rotation. Such rotation, as contrasted with the non-rotation in the central region of the retort, can account for the relatively higher void fraction adjacent the walls of the retort. It is also possible that either or both of these phenomena may be occurring.

BRIEF SUMMARY OF THE INVENTION

A method is provided for forming an in situ oil shale retort in a subterranean formation containing oil shale. According to the method at least one either horizontally or vertically or horizontally and vertically void is formed within the boundaries of an in situ oil shale retort side, leaving a zone of unfragmented formation adjacent such a void. A first group of substantially vertically extending shot holes is drilled into the zone of unfragmented formation adjacent the boundaries of the retort. A second group of substantially parallel, substantially vertically extending shot holes is drilled into the zone of unfragmented formation within the boundaries of the retort. The spacing between shot holes in the first group of shot holes is preferably closer than the spacing between shot holes in the second group of shot holes. Both groups of shot holes are loaded with explosive; preferably the average explosive charge in each of the shot holes in the first group of explosives is less than the average explosive charge in the shot holes of the second group. The explosive in both groups of shot holes are preferably shot in a single round with the explosive in the first group being shot slightly in advance of the explosive in the second group.

Detonation of the explosive in the first group of shot holes will cause a crack to propagate between adjacent holes along the boundaries of the retort. This crack can provide a gas leak path along the boundaries which, in turn, can minimize the component of force of expanding gas from the explosive charge which tends to cause explosive expansion away from the boundaries. The crack can also minimize boundary friction and rotation of particles adjacent the boundaries of the retort. By counteracting either or both of these effects the occurrence of a higher void fraction portion along the boundaries of the retort can be minimized.

DRAWINGS

These and other features and advantages of the present invention will be appreciated as the same becomes better understood by reference to the following detailed description when considered in connection with the accompanying drawings wherein.

DESCRIPTION

Figure 1:
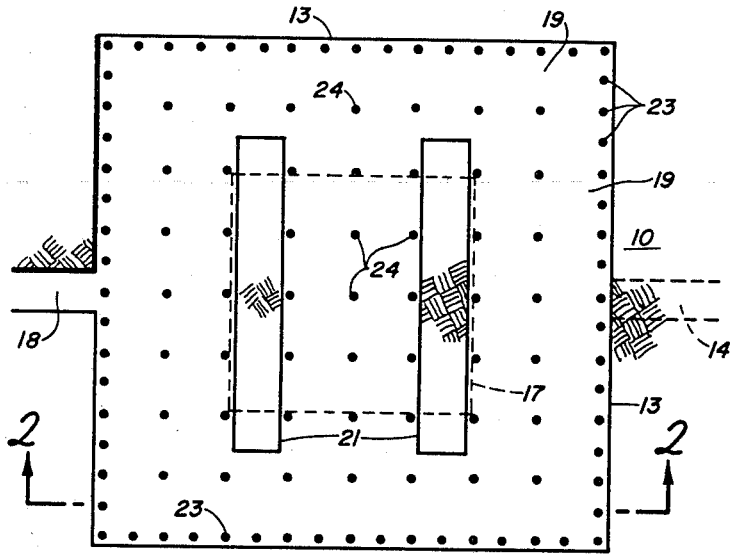
FIG. 1 is a semi-schematic horizontal cross section through an in situ oil shale retort site at an intermediate stage during formation of a retort.
Figure 2:
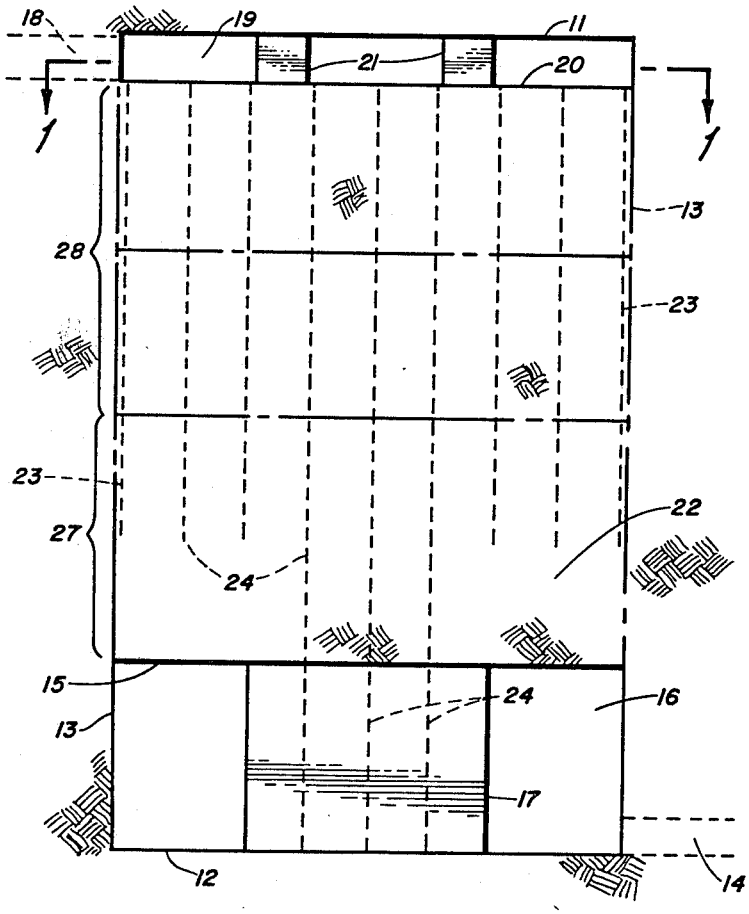
FIG. 2 is a semi-schematic vertical cross section through the retort site at line 2—2 in FIG. 1.

FIGS. 1 and 2 depict an exemplary in situ oil shale retort site after excavation of part of the formation to form the voids that provide the void volume in an in situ oil shale retort and before explosive expansion of formation to form such a retort. The retort site is in a subterranean formation 10 and has an upper boundary 11, a lower boundary 12, and side boundaries 13. In the illustrated embodiment, the retort has a square horizontal cross section, however, it will be understood that an unequal rectangular cross section or other cross section is suitable, and that a square cross section is illustrated solely for convenience.

In this embodiment a horizontally extending access drift 14 or the like is excavated through subterranean formation to a side boundary of the retort site at its lower level. A void 16 is excavated at this lower or production level via the access drift. The production level void extends horizontally across the retort site and has side boundaries substantially coinciding with the side boundaries 13 of the retort. The production level void is on the order of about 20 to about 25% of the total height of the retort between the lower boundary 12 and the upper boundary 11. Overlying unfragmented formation above the void has a horizontal free face 15 at the top of the void.

A support pillar 17 of unfragmented formation may be left within the void for the temporary support of overlying formation or overburden above the production level void. In the illustrated embodiment the pillar is rectangular in horizontal cross section and is somewhat wider than the height of the production level void. The pillar as shown occupies about 20% of the horizontal cross-sectional area of the void; that is, at the production level there is an extraction ratio of about 80%.

An upper or air level drift 18 is excavated through a side boundary of the retort site near its upper boundary 11. The air level drift provides access to the retort site for excavation of an upper or air level void 19. The air level void extends horizontally across the retort side and has side boundaries substantially coinciding with the side boundaries 13 of the retort. As with the production level one or more pillars may be left in the void for temporary support of the overlying formation. In the exemplary embodiment a pair of air level pillars 21 of unfragmented formation are left for this purpose. The air level pillars 21 are shown as relatively long rectangular pillars located within the air level void; this is desirable in that it provides effective access to substantially the entire horizontal cross section of the retort site for drilling and loading shot holes.

A thick zone 22 of unfragmented formation is left within the boundaries of the retort site between the upper air level void 19 and the lower production level void 16. In one example the zone 22 of unfragmented formation can occupy about 70% of the total retort height. The top of the zone has a free face 20 at the floor of the air level void.

It is understood that one or more vertically extending voids such as taught in U.S. Pat. No. 4,043,595, the disclosure of which is incorporated herein by this reference, to provide the requisite void volume for rubblization of the retort or the combination of one or more horizontal and one or more vertical voids are within the scope of the present invention.

To form an in situ oil shale retort, the pillars 17 and 21 in both voids are explosively expanded and the zone 22 of unfragmented formation between the voids is explosively expanded toward the voids to form a fragmented permeable mass of particles. The volume of excavated voids provides the void space between particles in the fragmented mass and the average void fraction in the fragmented mass is substantially determined by the available volume of the excavated voids. Thus, for example, when the total excavated volume of the two voids is between about 15% to about 25% of the total volume of the retort site, the resulting fragmented mass has an average void fraction of between about 15% to about 25%.

A first group of substantially vertical shot holes 23 are drilled downwardly from the air level void 19 into the zone 22 of unfragmented formation adjacent the side boundaries of the retort. Preferably the first group of shot holes 23 are located on the side boundary of the retort. A second group of substantially parallel, substantially vertical shot holes 24 are also drilled downwardly from the air level void into the remainder of zone 22 of unfragmented formation. Shot holes 23 and 24 are shown out of proportion, i.e., the diameter of the shot holes is actually much smaller in relation to the horizontal dimensions of the retort than is shown in FIGS. 1 and 2. In the illustrated embodiment the shot holes 24 are in a square array. Other arrangements or configurations are similarly suitable. It should also be apparent that shot holes 23 and 24 may be drilled downwardly from some other level in the formation above the air level, such as from the surface, or that they may be drilled upwardly, such as from the production level 16.

As shown best in FIG. 1, the average spacing between shot holes 23 is closer than the average spacing between shot holes 24. In an exemplary embodiment the average spacing between centers of shot holes 23 is on the order of from about 1 foot to about 8 feet, preferably from about 1 foot to about 6 feet, and most preferably from about 1 foot to about 4 feet. The average spacing between shot holes 24 is on the order of from about 6 feet to about 30 or more feet, preferably from about 8 feet to about 25 feet, and most preferably on 20 foot centers. The diameter of the first and second group of shot holes may be the same or the first group of shot holes may be drilled with a smaller diameter than the second group of shot holes. By way of example, the first group of shot holes can have a diameter of from about 1 inch to about 8 inches, preferably about 2 to about 4 inches, and the second group of shot holes can have a diameter of about 8 to about 15 inches, preferably about 10 inches.

A portion of the second group of shot holes 24 are drilled completely through the zone of formation between the upper and lower voids and through the support pillar 17 in the lower production level void. As shown, both groups of shot holes 23 and 24 in this exemplary embodiment are drilled most of the way through the intervening zone 22. Horizontal shot holes (not shown) are also drilled in the air level pillars 21. If desired, additional vertical shot holes can be drilled through the lower level pillar 17 or horizontal shot holes can be drilled in the lower level pillar.

Explosive charges (not shown) are placed in both groups of shot holes and the shot holes in the pillars for explosively expanding the pillars and zone of formation 22 between the two voids. Preferably the first group of shot holes will have less of an average explosive charge than the second group of shot holes. By way of example, each of shot holes 23 may be loaded with from about 0.30 to about 20.0 pounds per foot of an explosive such an ANFO, preferably from about 1.1 to about 4.4 pounds per foot, and each of the shot holes 24 may be loaded with from about 20 to about 70 pounds per foot of ANFO, preferably from about 25 to about 50 pounds per foot and most preferably about 30 pounds per foot. Moreover, it is not necessary for each of the shot holes in the first group to be charged with explosive, although in the preferred embodiment each of the first group of shot holes 23 will contain an explosive charge. It is also desirable for the top about 2 to about 3 feet of each shot hole 23 to be stemmed.

In this exemplary embodiment, the unfragmented formation 22 between the upper and lower voids is explosively expanded in two stages. In a first stage, a lower zone 27 is explosively expanded downwardly toward the underlying production level void 16. In a second stage an upper zone 28 is explosively expanded both upwardly and downwardly. Roughly half of the upper zone is expanded downwardly towards the void space overlying the fragmented mass formed by expansion of the lower zone 27, and roughly half of the upper zone 28 is explosively expanded upwardly towards the overlying air level void 19. These two zones 27 and 28 can be explosively expanded in a single round of explosions, or if desired a substantial time interval can elapse between expansion of the lower zone and expansion of the upper zone 28. The latter arrangement permits loading of explosive charges in shot holes 23 and 24 in the upper zone and in the air level pillars after explosive expansion of the lower level pillar and lower zone. Alternatively, all such explosive charges are loaded in a single operation and detonated in a single round including the production level pillar 17, the lower zone 27, the upper zone 28 and the air level pillars 21.

Explosive charges (not shown) are loaded in the array of both groups of shot holes 23 and 24 in the upper half of the lower zone 27. Stemming is provided above explosive charges in the longer shot holes 24 in the production level pillar to separate such charges from charges in the upper half of the lower zone 27 of unfragmented formation. Stemming is also provided in shot holes above the explosive charges in the upper half of the lower zone 27.

Another array of explosive charges is loaded in the center half of the upper zone 28, and the upper portions of the shot holes 23 and 24 are then stemmed. Thus, for example, in an embodiment where the upper zone 28 is about 100 feet thick, the lowermost 25 feet of the shot holes in that zone are stemmed; a 50 foot long explosive column is placed in the shot holes; and the upper 25 feet of the shot holes are stemmed.

Each of the explosive charges is provided with a detonator and booster (not shown) for detonating the respective explosive charge at a selected moment.

The first event in explosive expansion is detonation of explosive charges in the production level pillar 17 which explosively expands the pillar towards the side boundaries of the void. After a selected time interval explosive charges in the shot holes 23 in the lower zone 27 are detonated. At the same time or after a selected time interval explosive charges in shot holes 24 in the lower zone 27 are detonated for explosively expanding the lower zone downwardly towards the production level void. Detonation of the explosive charges in the pillar and in the lower zone is preferably in a single round, i.e., in a continuous series of explosions. It is not necessary that all of the explosive charges be detonated simultaneously and it is preferable to detonate such charges in sequence for minimizing the quantity of explosive detonated at any instant to reduce the blasting damage due to the seismic impact. In practice of this invention a time interval is provided between detonation of explosive in the production level pillar and detonation of explosive in shot holes 23 and 24 in the overlying zone 27 of unfragmented formation above the void.

The time interval between detonation of explosive in the pillar and in the adjacent zone of unfragmented formation is preferably at least sufficient for a principal portion of the pillar fragments to travel to the side boundaries of the void.

The next event in forming a fragmented permeable mass of particles in the retort involves explosive expansion of the upper zone 28 towards the air level void 19 and the void space over the top of the fragmented mass formed by explosive expansion of the production level pillar 17 and lower zone 27. Explosive charges in the air level pillars 21 are detonated for explosively expanding the pillars. After a time interval, e.g., sufficient for a principal portion of the pillar fragments to travel to the side boundaries of the void, explosive is detonated in shot holes 23 and 24 in the upper zone 28. This causes propagation of a crack between adjacent shot holes 23 in the upper zone and explosive expansion of roughly the lower half of this zone downwardly towards void space over the underlying fragmented mass and roughly the upper half of the zone towards the overlying air level void.

Development of the crack between adjacent shot holes 23 can prevent the formation of a retort with a relatively higher void volume adjacent the boundaries of the retort than at the center of the retort. The crack can provide a gas leak path along the boundaries which, in turn, can minimize the component of force of expanding gas generated by the explosion of the charges in shot holes 24, i.e., the component of force which tends to cause explosive expansion away from the boundaries. The crack can also minimize boundary friction and rotation of particles adjacent the boundaries of the retort. By counteracting either or both of these effects the occurrence of a higher void fraction portion along the boundaries of the retort can be minimized.

Figure 3:
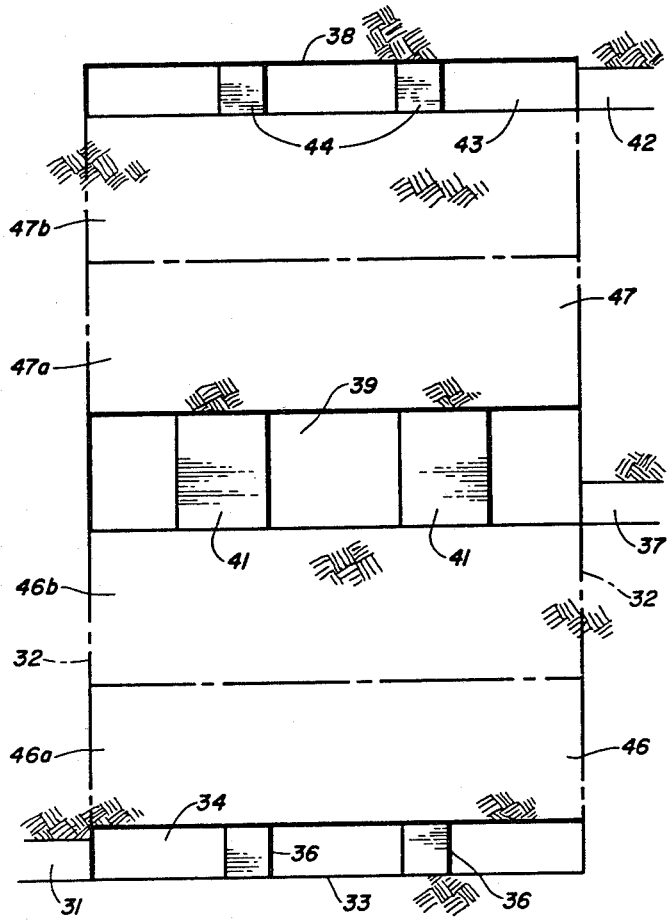
FIG. 3 is a semi-schematic vertical cross section through another embodiment of in situ oil shale retort at an intermediate stage of formation according to principles of this invention; and, FIG. 4 is a vertical cross section showing a rubblized retort prepared according to the principles of the present invention in the process of being retorted.
Figure 4:
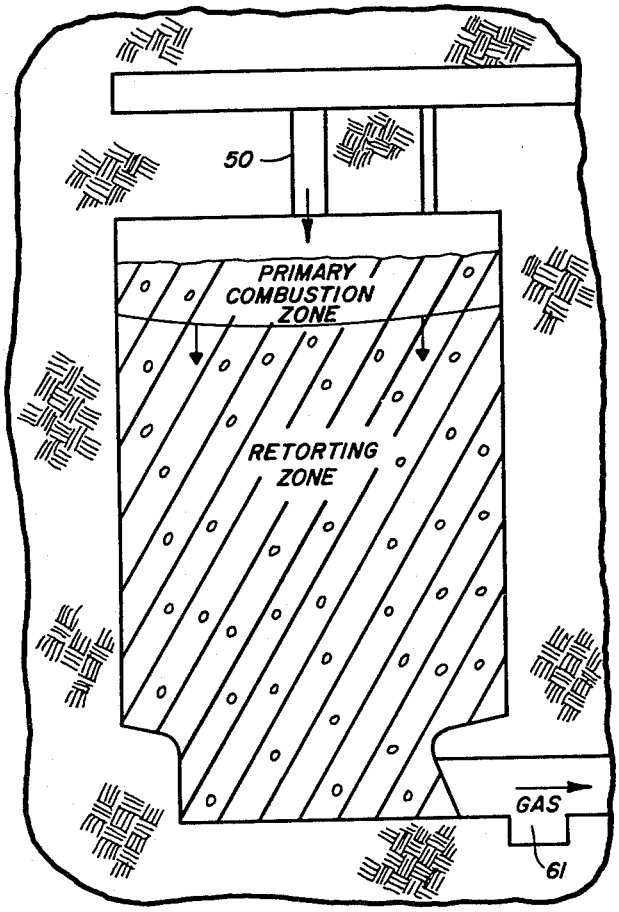

FIG. 3 illustrates in vertical cross section another exemplary embodiment of an in situ oil shale retort site after excavation of voids within the boundaries of the retort and before explosive expansion. A lower production level access drive 31 is excavated to a side boundary 32 of the retort site near the lower boundary 33. A horizontally extending production level void 34 is excavated at the lower boundary of the retort via the access drift 31. The side boundaries of the production level void substantially coincide with the side boundaries 32 of the retort. A pair of relatively long narrow support pillars 36 of unfragmented formation are left within the side boundaries of the production level void for supporting overlying formation.

An intermediate level access drift 37 is excavated to a side boundary of the retort site approximately half-way between the lower boundary 32 and upper boundary 38 of the retort. An intermediate level void 39 is excavated via the intermediate level access drift 37. The intermediate level void extends horizontally across the retort site and its side boundaries coincide substantially with the side boundaries of the retort being formed. Four rectangular pillars 41 of unfragmented formation are left in the intermediate void 39 for temporary support of overlying formation. In the illustrated embodiment each of the four pillars 41 is centrally located in a quadrant of the intermediate level void. Collectively the intermediate level pillars 41 occupy about 20% of the horizontal cross-sectional area of the retort site. Thus, the extraction ratio at the intermediate level void is about 80%.

An air level access drift 42 is excavated to a side boundary of the retort site near the upper boundary 38. From this drift an upper horizontally extending void 43 is excavated with side boundaries substantially coinciding with side boundaries of the retort being formed. A pair of elongated pillars 44 of unfragmented formation are left in the air level void for support of overlying formation. The air level pillars 44 can be similar to the production level pillars 36 and are arranged in the air level void to provide effective access to substantially the entire horizontal cross-sectional area of the retort site for drilling and loading of shot holes and the like. Excavation of the upper, intermediate, and lower voids in the retort site leaves a lower zone 46 of unfragmented formation between the lower void and the intermediate void, and an upper zone 47 of unfragmented formation between the intermediate void and the upper void. Such zones of unfragmented formation are explosively expanded towards the free faces adjacent the voids for forming a fragmented mass of formation particles in the retort.

As with the exemplary embodiment of FIGS. 1 and 2 two sets of shot holes (not shown) are drilled and loaded with explosive in preparation for explosive expansion of particles in the retort. The first group of shot holes are positioned along the periphery of the retort and the second group of shot holes are within the first group, spaced throughout the remainder of the unfragmented formation to be explosively expanded. As was also the case with the illustrative embodiment described in detail in FIGS. 1 and 2, the first group of shot holes are preferably spaced closer together than the second group of shot holes, the first group of shot holes are preferably smaller in diameter than the second group and the average explosive charge in the first group of shot holes is preferably less than the average explosive charge in the second group of shot holes.

Horizontal shot holes are drilled in the lower level pillars 36 and upper level pillars 44 for explosive expansion thereof. Either vertical or horizontal, preferably horizontal, shot holes are drilled in the intermediate level pillars 41. Explosive charges are also loaded into the shot holes in the pillars. Preferably the explosive in the pillars and two zones of unfragmented formation are detonated in a single round with suitable short time delays within the round. Alternatively, if desired, the lower zone 46 of unfragmented formation can be explosively expanded before the upper zone 47.

Explosive is first detonated in the lower level pillars 36 and/or intermediate level pillars 41 for explosively expanding such pillars toward the surrounding void. The upper level pillars 44 can be explosively expanded at the same time or somewhat later.

After a time interval, e.g., sufficient for a principal portion of the pillar fragments to travel to the side boundaries of the respective void, explosive is detonated in the first group of shot holes in the lower zone 46 of unfragmented formation. These explosions cause a crack to propagate between adjacent shot holes in the first group of shot holes. At the same time or after a suitable time interval explosive is detonated in the second group of shot holes in the lower zone 46. Explosive can also be detonated in the same sequence in the upper zone 47 at about the same time or somewhat thereafter.

Upon detonation of the explosive and propagation of the crack along the side boundaries of the retort, approximately one-half **46*a* of the lower zone expands downwardly toward the production level void 34 and approximately one-half 46*b* expands upwardly toward the intermediate void 39. Similarly about one-half of the upper zone 47*a* expands downwardly towards the intermediate void 39 and the other half 47*b* expands upwardly towards the overlying air level void 43**.

Each half of these zones of unfragmented formation can be considered a zone expanding towards its respective void. Thus, a zone **46*a* above the lower void is expanded downwardly toward the void. An uppermost zone 47*b* below the air level void expands upwardly towards that void. Two zones, 44*b* below the intermediate void and 47*a*** above the intermediate void. To accommodate such expansion and assure reasonably uniform void fraction distribution in the resulting fragmented mass, the volume excavated from intermediate level void is approximately twice the volume excavated from either the upper or lower level void.

The recovery of shale oil and gaseous products from the oil shale in the retort generally involves the movement of a retorting zone through the fragmented permeable mass of formation particles in the retort. The retorting zone can be established on the advancing side of a combustion zone in the retort or it can be established by passing heated gas through the retort. It is generally preferred to advance the retorting zone from the top to the bottom of a vertically oriented retort, i.e., a retort having vertical side boundaries. With this orientation, the shale oil and product gases produced in the retorting zone move downwardly toward the base of the retort for collection and recovery aided by the force of gravity and gases introduced at an upper elevation.

A combustion zone can be established at or near the upper boundary of a retort by any of a number of methods. Reference is made to U.S. Pat. No. 4,147,593, and assigned to the assignee of the present application, and incorporated herein by this reference for one method in which an access conduit 50 is provided to the upper boundary of the retort and a combustible gaseous mixture is introduced therethrough and ignited in the retort. Off gas is withdrawn through an access means such as the drift extending to the lower boundary of the retort, thereby bringing about a movement of gases from top to bottom of the retort through the fragmented permeable mass of formation particles containing oil shale. A combustible gaseous mixture of a fuel, such as propane, butane, natural gas, or retort off gas, and air is introduced through the access conduit 50 to the upper boundary and is ignited to initiate a combustion zone at or near the upper boundary of the retort. Combustible gaseous mixtures of oxygen and other fuels are also suitable. The supply of combustible gaseous mixture of the combustion zone is maintained for a period sufficient for the oil shale at the upper boundary of the retort to become heated, usually to a temperature of greater than about 900° F. so combustion can be sustained by the introduction of air without fuel gas into the combustion zone. Such a period can be from about one day to about a week in duration.

The combustion zone is sustained and advanced through the retort toward the lower boundary by introducing any oxygen containing retort inlet mixture through the access conduit 50 to the upper boundary of the retort, and withdrawing gas from below the retorting zone. The inlet mixture, which can be a mixture of air and a diluent such as retort off gas or water vapor, can have an oxygen content of about 10% to 20% of its volume. The retort inlet mixture is introduced to the retort at a rate of about 0.5 to 2 standard cubic feet of gas per minute per square foot of cross-sectional area of the retort.

The introduction of gas at the top and the withdrawal of off gas from the retort at a lower elevation serve to maintain a downward pressure differential of gas to carry hot combustion product gases and non-oxidized inlet gases (such as nitrogen, for example) from the combustion zone downwardly through the retort. This flow of hot gas establishes a retorting zone on the advancing side of the combustion zone wherein particulate fragmented formation containing oil shale is heated. In the retorting zone, kerogen in the oil shale is retorted to liquid and gaseous products. The liquid products, including shale oil, move by gravity toward the base of the retort where they are collected in a sump and pumped to the surface. The gaseous products from the retorting zone mix with the gases moving downwardly through the in situ retort and are removed as retort off gas from a level below the retorting zone. The retort off gas is the gas removed from such lower level of the retort and transferred to the surface. The off gas includes retort inlet mixture which does not take part in the combustion process, combustion gas generated in the combustion zone, product gas generated in the retorting zone, and carbon dioxide from decomposition of carbonates contained in the formation.

Although the method for forming an in situ oil shale retort has been described and illustrated in two embodiments, many modifications and variations will be apparent to one skilled in the art. Thus, other arrangements wherein a horizontally extending void is excavated, leaving a zone of unfragmented formation above and/or below such a void are contemplated, such as an arrangement having plural intermediate voids as described and illustrated in U.S. Pat. No. 4,192,554. Other arrangements of explosive charges for expansion of pillars and/or zones of unfragmented formation above and/or below such voids will be apparent. Thus, for example, decking of charges of explosive in a zone of unfragmented formation can be employed as described in U.S. Pat. No. 4,146,272. A variety of techniques for blasting pillars are disclosed in U.S. Pat. No. 4,300,800, entitled *METHOD OF RUBBLING A PILLAR,* issued Nov. 17, 1981, by Thomas E. Ricketts. The patent and application are incorporated herein by reference. Since many such variations and modifications are contemplated, this invention should not be limited except as recited in the following claims.

What is claimed is:

1. A method for recovering liquid and gaseous products from an in situ oil shale retort formed in a retort site in a subterranean formation containing oil shale, the retort having boundaries of unfragmented formation and containing a fragmented permeable mass of formation particles containing oil shale comprising the steps of:

(a) excavating formation from within the retort site for forming at least one void extending horizontally across the retort site, leaving zones of unfragmented formation above and below such a void;

(b) drilling a first group of substantially parallel shot holes and a second group of substantially parallel shot holes into at least one of the zones of unfragmented formation within the retort site, the first group of shot holes being adjacent at least one of the boundaries of the retort site, the distance between adjacent shot holes in the first group of shot holes being less than the distance between adjacent shot holes in the second group of shot holes;

(c) placing explosive charges in the first and second group of shot holes;

(d) detonating the explosive charges in the first group of shot holes to propagate a crack extending between adjacent shot holes in the first group of shot holes and thereafter detonating the explosive charges in the second group of shot holes to explosively expand the zone of unfragmented formation towards the void for forming a fragmented permeable mass of formation particles in the retort;

(e) establishing a retorting zone in an upper portion of the fragmented mass;

(f) introducng a retorting gas into the fragmented mass for sustaining the retoring zone and for advancing the retorting zone through the fragmented mass; and, (g) withdrawing liquid and gaseous products of retorting from a lower portion of the fragmented mass on the advancing side of the retorting zone.

2. A method for recovering liquid and gaseous products from an in situ oil shale retort as defined in claim 1 wherein the average distance between adjacent shot holes in the first group of shot holes is from about 1 foot to about 8 feet.

3. A method for recovering liquid and gaseous products from an in situ oil shale retort as defined in claim 1 wherein the average distance between adjacent shot holes in the second group of shot holes is from about 6 to about 30 feet.

4. A method for recovering liquid and gaseous products from an in situ oil shale retort as defined in claim 1 wherein the diameter of the shot holes in the first group of shot holes is less than the diameter of the shot holes in the second group of shot holes.

5. A method for recovering liquid and gaseous products from an in situ oil shale retort as defined in claim 4 wherein the diameter of the shot holes in the first group of shot holes is from about 1 inch to about 8 inches.

6. A method for recovering liquid and gaseous products from an in situ oil shale retort as defined in claim 1 wherein the average explosive charge in the first group of shot holes is less than the average explosive charge in the second group of shot holes.

7. A method for recovering liquid and gaseous products from an in situ oil shale retort as defined in claim 6 wherein the average explosive charge in the first group of shot holes is from about 0.3 to about 20 pounds of explosive (ANFO) per foot of hole.

8. A method for recovering liquid and gaseous products from an in situ oil shale retort as defined in claim 1 wherein the explosive in the first group of shot holes are detonated prior to detonation of the explosive in the second group of shot holes.

9. A method for recovering liquid and gaseous products from an in situ oil shale retort formed in a retort site in a subterranean formation containing oil shale, the retort having side, top and bottom boundaries of unfragmented formation and containing a fragmented permeable mass of formation particles containing oil shale comprising the steps of:

(a) excavating formation from within the retort site for forming at least one void extending horizontally across the retort site, leaving zones of unfragmented formation above and below such a void;

(b) drilling a first group of substantially parallel shot holes and a second group of substantially parallel shot holes into at least one of the zones of unfragmented formation within the retort site, the first group being substantially parallel to the second group, the first group of shot holes being adjacent to each of the side boundaries of the retort site, the distance between adjacent shot holes in the first group of shot holes being less than the distance between adjacent shot holes in the second group of shot holes;

(c) placing explosive charges in at least one of the first group of shot holes on each side of the retort and placing explosive charges in the shot holes of the second group of shot holes;

(d) detonating the explosive charges in the first group of shot holes to propagate a crack extending between adjacent shot holes in the first group of shot holes and thereafter detonating the explosive charges in the second group of shot holes to explosively expand the zone of unfragmented formation towards the void for forming a fragmented permeable mass of formation particles in the retort;

(e) establishing a retorting zone in an upper portion of the fragmented mass;

(f) introducing a retorting gas into the fragmented mass for sustaining the retorting zone and for advancing the retoring zone through the fragmented mass; and, (g) withdrawing liquid and gaseous products of retorting from a lower portion of the fragmented mass on the advancing side of the retorting zone.

10. A method as defined in claim 9 wherein the average distance between adjacent shot holes in the first group of shot holes is from about 1 foot to about 8 feet.

11. A method as defined in claim 9 wherein the excavated void extends horizontally across the retort site.

12. A method as defined in claim 9 wherein the diameter of the shot holes in the first group of shot holes is less than the diameter of the shot holes in the second group of shot holes.

13. A method as defined in claim 9 wherein the average explosive charge in the first group of shot holes is less than the average explosive charge in the second group of shot holes.

14. A method as defined in claim 9 wherein the explosive charges in the first group of shot holes are detonated prior to detonation of the explosive charges in the second group of shot holes.

15. A method as defined in claim 9 wherein the second group of shot holes is within the periphery defined by the first group of shot holes.

16. A method for recovering liquid and gaseous products from an in situ oil shale retort formed in a retort site in a subterranean formation containing oil shale, the in situ oil shale retort containing a fragmented permeable mass of formation particles within the top, bottom and side boundaries of the retort comprising the steps of:

(a) excavating at least one horizontally extending void within the boundaries of the retort site leaving zones of unfragmented formation above and below such a void;

(b) drilling a first group of substantially parallel shot holes and a second group of substantially parallel shot holes into at least one of the zones of unfragmented formation within the retort site, the first group being substantially parallel to the second group and adjacent the side boundaries of the retort site and the second group being within the periphery defined by the first group, the distance between adjacent shot holes in the first group of shot holes being less than the distance between adjacent shot holes in the second group of shot holes;

(c) placing explosive charges in at least one of the first group of shot holes on each side of the retort and placing explosive charges in the shot holes of the second group of shot holes wherein the average explosive charge in each of the shot holes in the first group of shot holes having explosive therein is less than the average explosive charge in each of the shot holes in the second group of shot holes;

(d) detonating the explosive in the first group of shot holes to propagate a crack between adjacent shot holes in the first group of shot holes and thereafter detonating the explosive charges in the second group of shot holes to explosively expand the zone of unfragmented formation toward the void for forming a fragmented permeable mass of formation particles in the retort;

(e) establishing a retorting zone in an upper portion of the fragmented mass;

(f) introducing a retorting gas into the fragmented mass for sustaining the retorting zone and for advancing the retorting zone through the fragmented mass; and, (g) withdrawing liquid and gaseous products of retorting from a lower portion of the fragmented mass on the advancing side of the retorting zone.

17. A method as defined in claim 16 wherein the average distance between adjacent shot holes in the first group of shot holes is from about 1 foot to 8 feet.

18. A method as defined in claim 16 wherein the diameter of the shot holes in the first group of shot holes is less than the diameter of the shot holes in the second group of shot holes.

* * * * *